US008248441B2

(12) United States Patent
Howell

(10) Patent No.: US 8,248,441 B2
(45) Date of Patent: Aug. 21, 2012

(54) THERMAL TRANSFER PRINTING

(75) Inventor: Jeffrey Michael Howell, Ipswich (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 193 days.

(21) Appl. No.: 12/739,914

(22) PCT Filed: Oct. 23, 2008

(86) PCT No.: PCT/GB2008/003631

§ 371 (c)(1),
(2), (4) Date: Apr. 26, 2010

(87) PCT Pub. No.: WO2009/053721

PCT Pub. Date: Apr. 30, 2009

(65) Prior Publication Data

US 2010/0245523 A1 Sep. 30, 2010

(30) Foreign Application Priority Data

Oct. 27, 2007 (GB) ..... 0721127.9

(51) Int. Cl.
*B41M 5/025* (2006.01)
*B41M 5/035* (2006.01)
*B41F 16/00* (2006.01)

(52) U.S. Cl. ..... 347/212

(58) Field of Classification Search ..... 347/212, 347/213, 171, 172, 174, 176
See application file for complete search history.

(56) References Cited

U.S. PATENT DOCUMENTS

| | | | | |
|---|---|---|---|---|
| 5,643,387 | A * | 7/1997 | Berghauser et al. | 156/230 |
| 6,251,825 | B1 * | 6/2001 | Richardson | 503/227 |
| 7,102,660 | B2 * | 9/2006 | Clifton et al. | 347/217 |
| 2006/0070546 | A1 * | 4/2006 | Smith et al. | 101/488 |

FOREIGN PATENT DOCUMENTS

| | | | | |
|---|---|---|---|---|
| CA | 2 276 556 | | 12/2000 | |
| FR | 2728505 | * | 6/1996 | |
| JP | 06-247058 | * | 9/1994 | 503/227 |
| WO | WO 98/02315 | | 1/1998 | |
| WO | WO 01/96123 | | 12/2001 | |
| WO | WO 02/096661 | | 12/2002 | |
| WO | WO 2004/022354 | | 3/2004 | |

OTHER PUBLICATIONS

International Search Report and Written Opinion, PCT International Patent Application No. PCT/GB2008/003631, dated Feb. 18, 2009.
Reply to Written Opinion, PCT International Patent Application No. PCT/GB2008/003631, dated Jul. 22, 2009.
International Preliminary Report on Patentability, PCT International Patent Application No. PCT/GB2008/003631, dated Nov. 5, 2009.

* cited by examiner

*Primary Examiner* — Huan Tran
(74) *Attorney, Agent, or Firm* — Kenyon & Kenyon LLP

(57) ABSTRACT

A support for an article onto which an image is to be printed by thermal transfer printing from a retransfer intermediate sheet has a surface shaped for engagement with the article, at least a portion of the surface being formed from an elastomeric material. Also disclosed are a method of making a support, apparatus for thermal transfer printing, a method of printing and an article bearing a printed image.

14 Claims, 6 Drawing Sheets

THERMAL TRANSFER PRINTING

FIELD OF THE INVENTION

This invention relates to thermal transfer printing, and concerns a support for an article onto which an image is to be printed by thermal transfer printing from a retransfer intermediate sheet, a support with an article, a method of making a support, apparatus for thermal transfer printing, a method of printing and an article bearing a printed image.

BACKGROUND TO THE INVENTION

Thermal transfer printing involves forming an image (in reverse) on a retransfer intermediate sheet using one or more thermally transferable dyes. The image is then thermally transferred to a surface of an article by bringing the image into contact with the article surface and applying heat and typically also pressure. Thermal transfer printing is particularly useful for printing onto articles that are not readily susceptible of being printed on directly, particularly three-dimensional (3D) articles. Thermal transfer printing by dye diffusion thermal transfer printing, using sublimation dyes, is disclosed, e.g., in WO 98/02315 and WO 02/096661. By using digital printing techniques to form the image on the retransfer intermediate sheet, high quality images, possibly of photographic quality, can be printed on 3D articles relatively conveniently and economically even in short runs. Indeed such articles can be personalised economically.

Using suitable retransfer intermediate sheets, it is possible to form good quality images on 3D articles, possibly having complex shapes including curved shapes (concave or convex) including compound curves. When printing onto 3D articles, the sheet is typically preheated, e.g. to a temperature in the range 80 to 170° C., prior to application to the article, to soften the sheet and render it deformable. The softened sheet is then in a condition in which it can be easily applied to and conform to the contours of an article. This is conveniently effected by establishing a pressure difference across the softened sheet to cause it to mould to the article. The pressure difference is typically 40 kPa, and is typically applied as a vacuum to that side of the sheet which is applied to the article. While the sheet is maintained in contact with the article, e.g. by maintenance of the pressure difference, the sheet, and also the article, are heated to a suitable temperature for dye transfer, typically a temperature in the range 140 to 200° C., for a suitable time, typically in the range 15 to 150 seconds. After dye transfer, the article is allowed or caused to cool before removal of the retransfer intermediate sheet. Suitable apparatus for performing the retransfer printing step is disclosed e.g. in WO 01/96123 and WO 2004/022354.

The pressure difference across the sheet causes a force to be exerted on the article, which, at the temperature to which the article is heated for dye transfer, can cause deformation of the article, especially if it is made of thin metal or plastics materials that soften on heating.

The article is therefore typically placed on a rigid support, referred to as a "nest", that limits deformation of the article during thermal transfer printing.

The part of the support on which the article is placed typically forms a relatively loose fit with the article because of the need to accommodate manufacturing tolerances in the dimensions of the article and different rates of thermal expansion of the support and the article, such that there can be gaps between the support and the article.

Where there is a gap between the support and the article, deformation of the article can occur when the article is heated and a force is exerted on the article, despite the presence of the support. Moreover, where there is a gap between the support and an edge of the article, the softened sheet can be forced into the gap by the pressure difference across the sheet and can rupture, so that the pressure difference is lost. In that event the dye transfer from the sheet to the article is likely to be unsatisfactory.

SUMMARY OF THE INVENTION

In one aspect, the present invention provides a support for an article onto which an image is to be printed by thermal transfer printing from a retransfer intermediate sheet, the support having an engagement surface generally shaped for engagement with the article, wherein at least a portion of the engagement surface is formed from an elastomeric material.

The support is designed for use with a particular article such that when the article is engaged with the engagement surface, at least a portion of the elastomeric material conforms to at least a part of an associated part of the article, the associated part being that part of the article which is engaged with the engagement surface, such that a gap that would otherwise be present between the associated part of the article and the engagement surface is occupied by the elastomeric material.

The support may be customised to suit particular articles by varying one or more factors including the size, shape and thermal conductivity of the support and the elastomeric material.

The elastomeric material is preferably shaped such that, at least at a temperature at which thermal transfer printing takes place, when the article is engaged with the engagement surface at least part of the elastomeric material conforms to at least part of the associated part of the article.

By so shaping the elastomeric material, during thermal transfer printing the elastomeric material occupies any gap that would otherwise be present between the support and the associated part of the article and prevents deformation of the article.

The elastomeric material is preferably shaped such that, at least at a temperature at which thermal transfer printing takes place, when the article is engaged with the engagement surface the elastomeric material conforms to an edge of the article.

By so shaping the elastomeric material, when the article is engaged with the surface, during thermal transfer printing the elastomeric material occupies any gap that would otherwise be present between the engagement surface and the edge of the article, so that the softened retransfer intermediate sheet cannot be forced into the gap.

The elastomeric material is more preferably still shaped such that, at least at a temperature at which thermal transfer printing takes place, when the article is engaged with the engagement surface the elastomeric material conforms to a peripheral edge of the article.

By so shaping the elastomeric material, during thermal transfer printing the elastomeric material occupies any gap that would otherwise be present between the engagement surface and the sides of the article, i.e. those parts of the article to which the softened retransfer intermediate sheet is applied nearest to the support, so that the softened sheet cannot be forced into the gap.

To this end the elastomeric material may conveniently have the form of a solid pad of generally similar shape to a footprint of the article, but of larger area, so that when the article is engaged with the engagement surface, the peripheral edge of the article is located inside a peripheral edge of the pad.

Alternatively the elastomeric material may conveniently have the form of a peripheral pad that occupies the periphery of the engagement surface, a peripheral edge of the pad being of generally similar shape to, but defining a larger area than, a footprint of the article, and the pad having an interior edge defining an opening in the pad, so that when the article is engaged with the engagement surface, the peripheral edge of the article is located between the peripheral edge of the pad and the interior edge of the pad.

The elastomeric material may advantageously be shaped such that, at least at a temperature at which thermal transfer printing takes place, when the article is engaged with the engagement surface the elastomeric material conforms to an edge of the article that defines an opening to a passage through the article.

By so shaping the elastomeric material, during thermal transfer printing the elastomeric material occupies any gap that would otherwise be present between the support and the edge of the article that defines the opening, so that the softened sheet cannot be forced through the passage into the gap.

Where the elastomeric material has the form of a solid pad, an inner portion of the pad may conveniently conform to the edge of the article that defines the opening to the passage through the article.

The inner portion of the pad may conveniently be constituted by a projection from the pad that conforms to the edge of the article that defines the opening to the passage through the article. The projection has an engagement surface that is of similar shape to, but larger area than, the opening defined by the edge of the article such that the opening is sealed by the engagement surface of the projection.

Where the elastomeric material has the form of a peripheral pad, an additional pad of the elastomeric material may advantageously be provided in the opening in the pad, the additional pad conforming to the edge of the article that defines the opening to the passage through the article.

The additional pad may conveniently be integrally formed with the peripheral pad.

It is envisaged that the elastomeric material could be shaped such that, at room temperature, when the article is engaged with the engagement surface, there is little or no contact between the edge of the article and the elastomeric material, the elastomeric material expanding, when heated to a temperature at which thermal transfer printing takes place, into engagement with the article so that the elastomeric material conforms to the article.

Preferably, however, the elastomeric material is shaped such that, at room temperature, when the article is engaged with the engagement surface, the article is engaged with the elastomeric material, which conforms to the article, the elastomeric material expanding when heated to a temperature at which thermal transfer printing takes place and further conforming to the article.

The support may advantageously comprise a relatively rigid body having a surface generally shaped for engagement with the article, and at least one pad formed from an elastomeric material, the at least one pad being provided in or on the engagement surface.

The engagement surface may advantageously be provided with at least one recess for receiving the at least one pad.

The at least one pad may advantageously be fastened into the at least one recess.

Preferably the support further comprises a plurality of relatively inextensible fibres, first ends of the fibres being attached to the body and second ends of the fibres being attached to the at least one pad.

Preferably the body is formed around the first ends of the fibres and the at least one pad is formed around the second ends of the fibres. The relatively inextensible fibres limit thermal is expansion of the at least one pad when the at least one pad is formed around the second ends of the fibres.

Where the engagement surface is provided with the at least one recess for receiving the at least one pad the body may advantageously be formed around the first ends of the fibres such that the second ends of the fibres protrude into the at least one recess, and the at least one pad be formed around the second ends of the fibres.

Where the engagement surface is provided with the at least one recess, the at least one recess may advantageously open re-entrantly or include a portion that opens re-entrantly, and the at least one pad be received in the at least one recess or the portion of the at least one recess, respectively, so as to fasten the at least one pad into the at least one recess.

The support may advantageously comprise a relatively rigid body and a pad formed from an elastomeric material that covers at least a portion of the body, the engagement surface being constituted by the pad.

Where the engagement surface is constituted by the pad, the support may advantageously further comprise a plurality of relatively inextendible fibres, first ends of the fibres being attached to the body and second ends of the fibres being attached to the pad.

Preferably the body is formed around the first ends of the fibres and the pad is formed around the second ends of the fibres.

The plurality of fibres prevent the pad from becoming detached from the body, which might otherwise occur due to poor adhesion (chemical incompatibility) between the body and the pad.

The support may advantageously comprise a body having an engagement surface shaped for engagement with the article, the body being formed from the elastomeric material and being provided with a structure that substantially prevents deformation of the parts of the body other than the engagement surface.

The structure may advantageously comprise at least one layer of relatively inextendible fibres, the body being formed around the at least one layer with the at least one layer disposed substantially parallel to the engagement surface.

Preferably the at least one layer of relatively inextendible fibres is constituted by at least one mat comprising a first plurality of fibres interwoven with, and substantially perpendicular to, a second plurality of fibres.

Alternatively the at least one layer may advantageously be constituted by at least one mat comprising a plurality of fibres arranged in substantially random orientations along the mat.

The at least one mat considerably limits extension of the body parallel to the engagement surface when the article is engaged with the support and a force applied to the article by the pressure difference across the softened sheet. The at least one mat also limits extension of the body parallel to the engagement surface due to thermal expansion of the body.

Where the support comprises a relatively rigid body having an engagement surface shaped for engagement with the article, and at least one pad formed from an elastomeric material, the rigid body may advantageously be machined from a relatively rigid material, such as metal or wood. Preferably the rigid body is formed in a mould, preferably from a hardenable resin, such as polyurethane or epoxy resin.

Where the rigid body is formed from a hardenable resin, the resin may advantageously include a metal or insulating filler powder to increase or decrease a thermal conductivity of the resin.

The elastomeric material may advantageously comprise a silicone resin such as Silastic (Silastic is a trade mark) silicone resin type S or V, available from Dow Corning Corporation.

The relatively inextendible fibres are preferably glass fibres.

The invention also lies in such a support with an article onto which an image is to be printed by thermal transfer printing from a retransfer intermediate sheet.

In a further aspect, the present invention provides a method of making a support for an article onto which an image is to be printed by thermal transfer printing from a retransfer intermediate sheet, the method comprising forming a support with an engagement surface generally shaped for engagement with the article, and forming at least a portion of the engagement surface from an elastomeric material.

Forming at least a portion of the engagement surface from an elastomeric material preferably comprises shaping the elastomeric material such that, at least at a temperature at which thermal transfer printing takes place, when the article is engaged with the engagement surface at least part of the elastomeric material conforms to at least part of the article.

Forming at least a portion of the engagement surface from an elastomeric material may advantageously comprise applying a hardenable elastomeric material to at least one portion of a cavity of a mould.

Preferably forming at least a portion of the engagement surface from an elastomeric material comprises applying a hardenable elastomeric material to at least one portion of a cavity of a mould, which cavity is formed using the article.

Where at least a portion of the engagement surface is so formed from the elastomeric material, forming a support with an engagement surface shaped for engagement with the article may advantageously comprise filling the cavity of the mould around the elastomeric material with a material that hardens to form a rigid structure.

Forming at least a portion of the engagement surface from an elastomeric material may advantageously further comprise placing a barrier in the cavity of the mould to define an edge of the portion of the engagement surface that is to be formed from the elastomeric material.

Where the method includes placing a barrier in the cavity of the mould, the barrier may advantageously be provided with a recess that opens re-entrantly, to produce a corresponding projection from the edge of the portion of the engagement surface that is defined by the barrier.

When the cavity of the mould around the elastomeric material is filled with the material that hardens to form a rigid structure, a recess that opens re-entrantly is formed in the support, the recess being occupied by the projection of the portion of the engagement surface, so as to fasten the portion of the engagement surface to the support.

The method may advantageously further comprise inserting first ends of a plurality of relatively inextendible fibres into the hardenable elastomeric material after applying the hardenable elastomeric material to at least one portion of the cavity of the mould, with second ends of the fibres extending into the mould cavity, before filling the cavity of the mould around the elastomeric material with a material that hardens to form a rigid structure.

The plurality of fibres fasten the elastomeric material to the rest of the support.

Forming at least a portion of the engagement surface from an elastomeric material may advantageously comprise filling a cavity of a mould to a first level with a hardenable elastomeric material.

Where at least a portion of the engagement surface is so formed from the elastomeric material, forming a support with an engagement surface shaped for engagement with the article may advantageously comprise forming a layer of relatively inextendible fibres over the hardenable elastomeric material in the cavity of the mould, then filling the remainder of the cavity with more of the hardenable elastomeric material to cover the layer of fibres.

Including the plurality of relatively inextendible fibres in the support makes the support resistant to extension parallel to the layer of fibres.

Forming a layer of relatively inextendible fibres over the hardenable elastomeric material in the cavity of the mould preferably comprises laying a mat comprising a first plurality of fibres interwoven with, and substantially perpendicular to, a second plurality of fibres, over the hardenable elastomeric material in the cavity of the mould.

Alternatively forming a layer of relatively inextendible fibres over the hardenable elastomeric material in the cavity of the mould may advantageously comprise laying a mat comprising a plurality of fibres arranged in substantially random orientations along the mat over the hardenable elastomeric material in the cavity of the mould.

In a further aspect, the present invention provides apparatus for thermal transfer printing of an image from a retransfer intermediate sheet onto an article, the apparatus including heating means adapted to supply a flow of heated gas for causing dye transfer, a pump adapted to establish a pressure difference across the sheet, and at least one support for the article, the at least one support having an engagement surface generally shaped for engagement with the article, at least a portion of the engagement surface being formed from an elastomeric material.

Preferably the elastomeric material is shaped such that, at least at a temperature at which thermal transfer printing takes place, when the article is engaged with the engagement surface at least part of the elastomeric material conforms to at least part of an associated part of the article.

The apparatus may be customised to suit particular articles by varying one or more factors including the number, size, thermal conductivity, position and configuration of the at least one support.

The apparatus may otherwise be of conventional construction and may be used in conventional manner.

The heating means thus conveniently comprise a heater element and a fan.

The heating means is operable to cause preheating of the sheet (typically to a temperature in the range 80 to 170° C.) to soften the sheet, and also for heating the sheet (typically to a temperature in the range 120 to 240° C., commonly about 160° C.) to cause dye transfer. The heating means may also be used for optional preheating of articles to be treated (typically to a temperature in the range 100 to 120° C.).

The heated gas is commonly air.

The apparatus includes means for bringing the sheet and article into intimate contact ready for the dye transfer step. Such means typically comprise vacuum means, with the apparatus thus being a vacuum press. The vacuum means conveniently comprise a vacuum pump and associated bleed valve.

The apparatus suitably includes means for holding a thermal retransfer sheet in position, over an article to be printed on.

Platform means are desirably provided for causing relative movement between the article and sheet, to bring the sheet (in softened condition after preheating) and article into contact, with the platform means conveniently including elevating means for raising and lowering the support.

The apparatus conveniently includes cooling means, typically in the form of a fan for directing a flow of cold air over the article and sheet after printing for cooling both.

The apparatus suitably includes computer control means for regulating operation of the heating means, vacuum means, cooling means and elevating means. The control means may include a number of preset programs suitable for printing a variety of different materials, and may also be programmable by a user to suit other requirements.

The apparatus can be used to print images onto articles made of a wide range of materials including plastics, metal, ceramics, wood, composite materials etc. with the articles being of solid or thin-walled construction. Depending on the nature of the surface of the article on which the image is to be printed, it may be appropriate to pre-treat the surface by application of a surface coating or lacquer to improve the take up of transferred dyes.

The apparatus is particularly intended for printing onto 3D articles, possibly having complex shapes including curved shapes (concave or convex) including compound curves.

Articles that have been printed to date include the shells of mobile telephones and computer mice, sports footwear and camera bags formed from moulded plastics materials.

Suitable thermal retransfer sheets are commercially available, such as Pictaflex media (Pictaflex is a Trade Mark) from ICI Imagedata.

Images may be formed on the retransfer sheet by printing with suitable thermally transferable dyes, preferably by inkjet printing.

In a further aspect, the present invention provides a method of printing an image from a thermal retransfer sheet onto an article, comprising causing the sheet and article to come into contact; and heating the sheet by exposure to a flow of heated gas to cause dye transfer from the sheet to the article, wherein the article is engaged with an engagement surface of a support, at least a portion of the engagement surface of the support being formed from an elastomeric material.

Preferably the elastomeric material is shaped such that, at least at a temperature at which thermal transfer printing takes place, when the article is engaged with the engagement surface at least part of the elastomeric material conforms to at least part of an associated part of the article, to prevent the article from being deformed.

The gas is commonly air.

The method generally includes a step of preheating the sheet by exposure to a flow of heated gas, to soften the sheet prior to bringing the sheet and article into contact.

The method may include an optional step of preheating the article, again typically by exposure to a flow of heated gas.

The preheated sheet and article are conveniently caused to come into contact by exposure to a vacuum. The vacuum is suitably at a level in the range 30 to 85 kPa (e.g. about 50 kPa) below atmospheric.

The method typically includes a final cooling step.

Preheating of the article is typically at a temperature in the range 100 to 120° C. for about 30 seconds, with conditions depending on the material of the surface of the article to be printed.

Preheating of the sheet is typically at a temperature in the range 80 to 170° C. for about 30 seconds, with a temperature of about 130° C. for 30 seconds being suitable for Pictaflex media.

Dye transfer is typically effected by heating at a temperature in the range 120 to 240° C., commonly about 160° C., for a time in the range 15 seconds to 5 minutes, with conditions depending on factors including the dyes, sheet and article.

The invention also includes within its scope an article bearing a printed image produced by the apparatus or method of the invention.

The invention also includes within its scope an article bearing a printed image produced using a support according to the invention.

An embodiment of a vacuum press in accordance with the invention for thermal transfer printing of an image from a thermal retransfer intermediate sheet on to a 3D article will now be described, as well as embodiments of supports for use in such apparatus, by way of illustration, with reference to the accompanying drawings, in which.

DETAILED DESCRIPTION OF THE DRAWINGS

Figure 1:
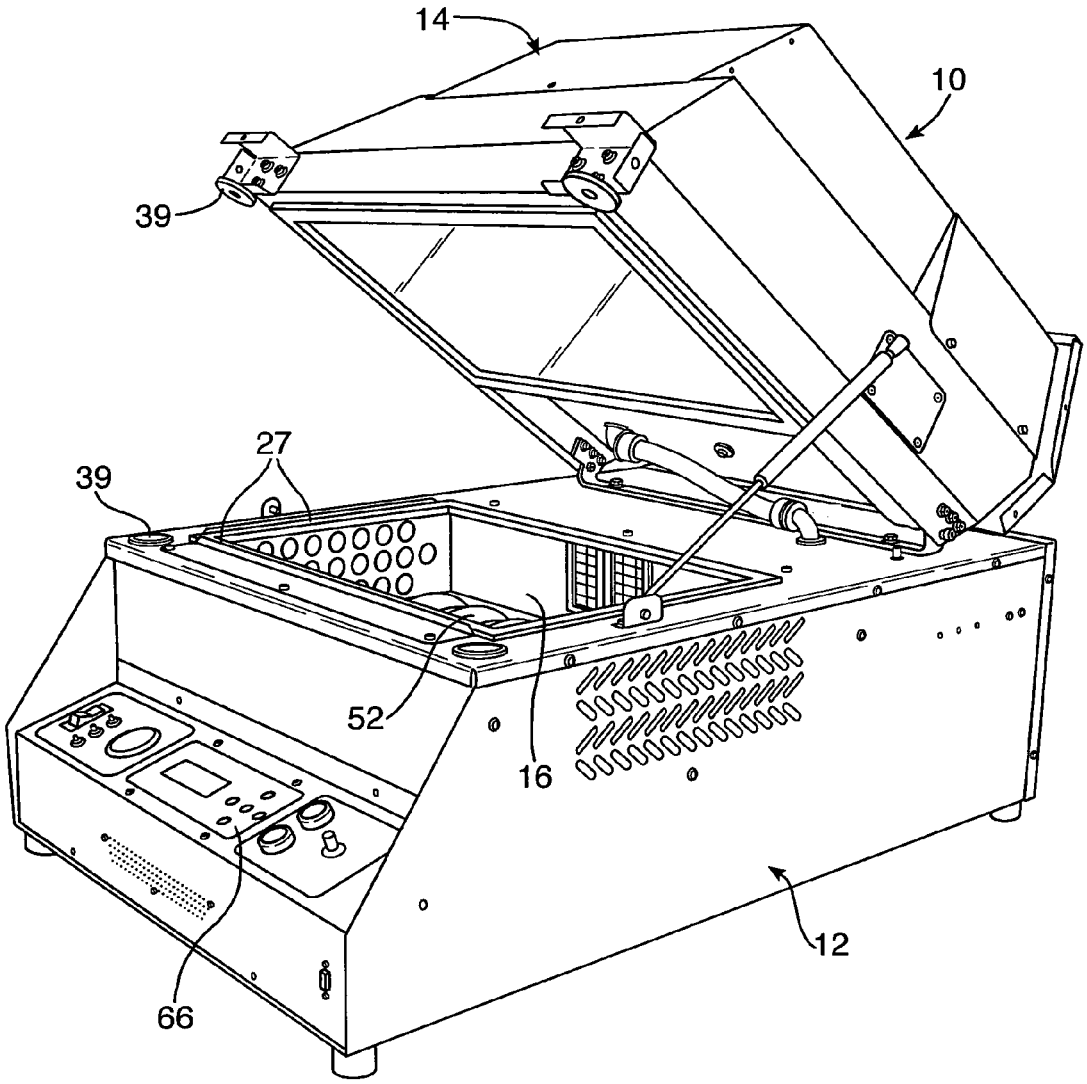
FIGS. 1 and 2 are perspective views of the vacuum press.
Figure 2:
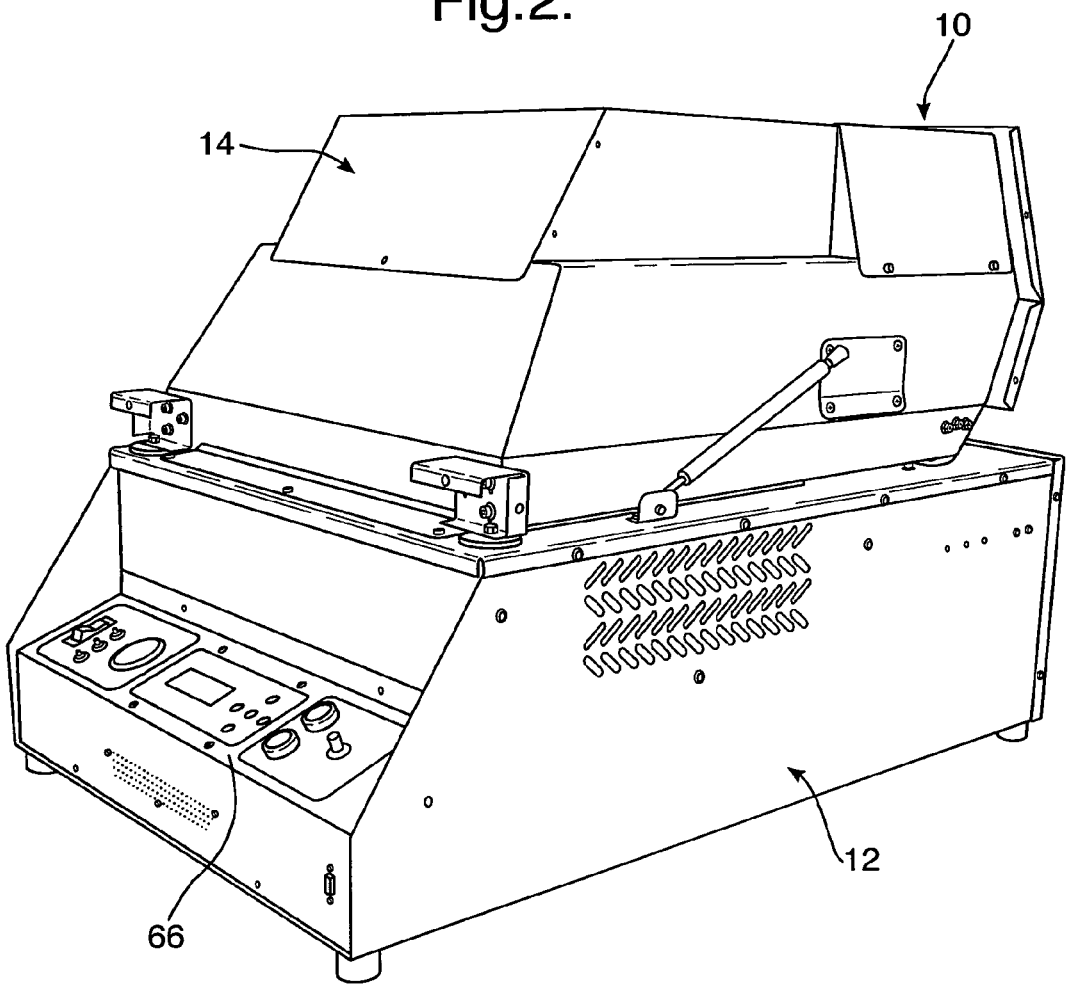

The illustrated vacuum press 10 is in the form of an A3 format desktop unit designed for use with an A3 retransfer sheet. The press is of generally cuboid shape, with overall dimensions of 800 mm depth, 600 mm height and 600 mm width. The press comprises a housing having a base unit 12 and a lid unit 14 hingedly connected thereto at the rear, with the lid unit being movable manually between an initial open position (as shown in FIG. 1) and a closed position for use (as shown in FIG. 2).

Figure 3:
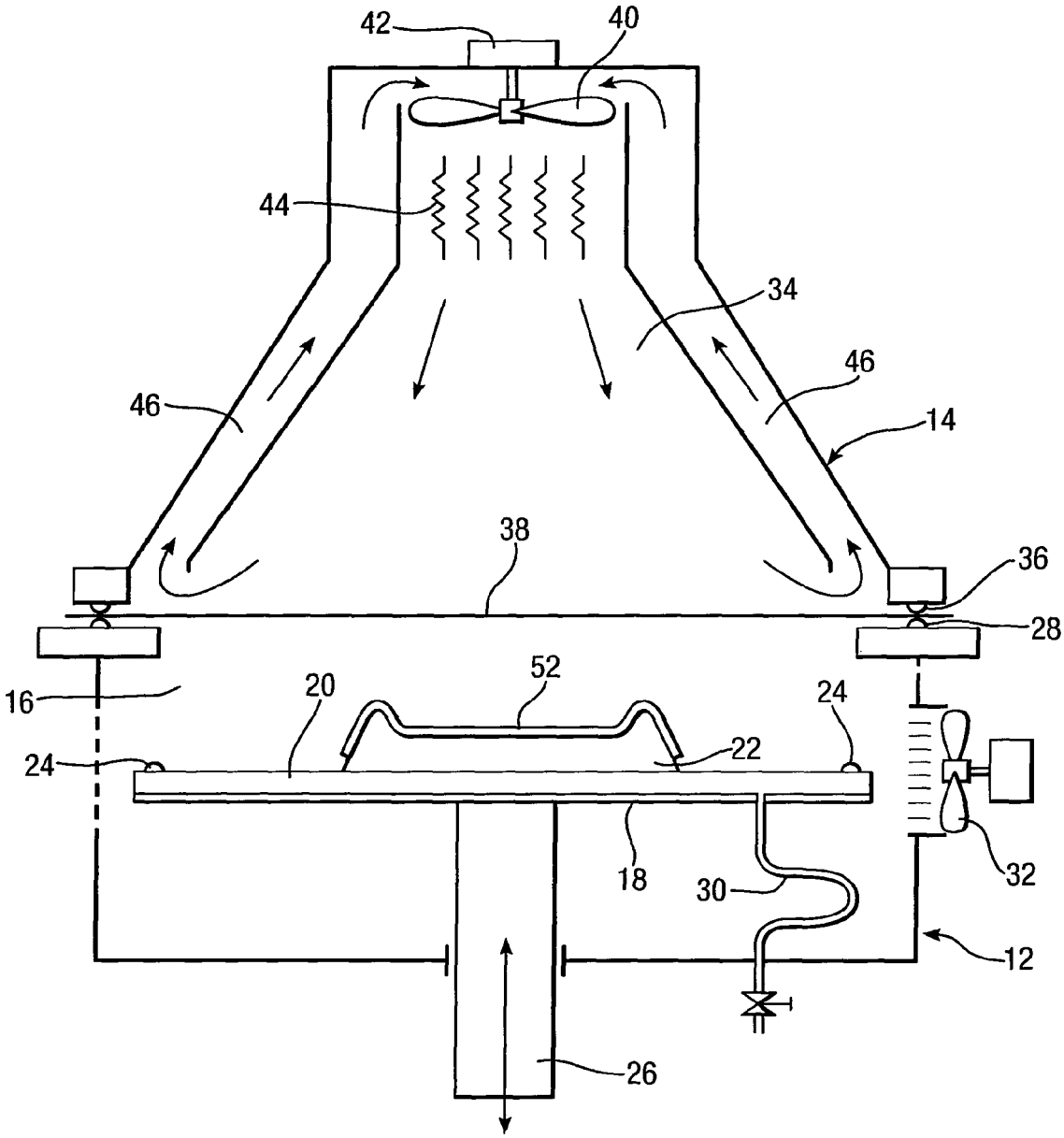
FIG. 3 is a schematic sectional view of internal components of the press.
Figure 4:
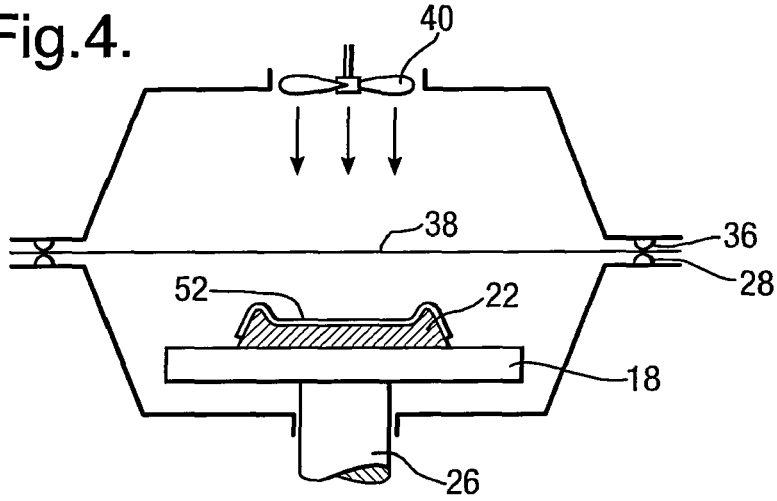
FIGS. 4 to 6 are schematic sectional views of internal components of the press at different stages in operation.
Figure 5:
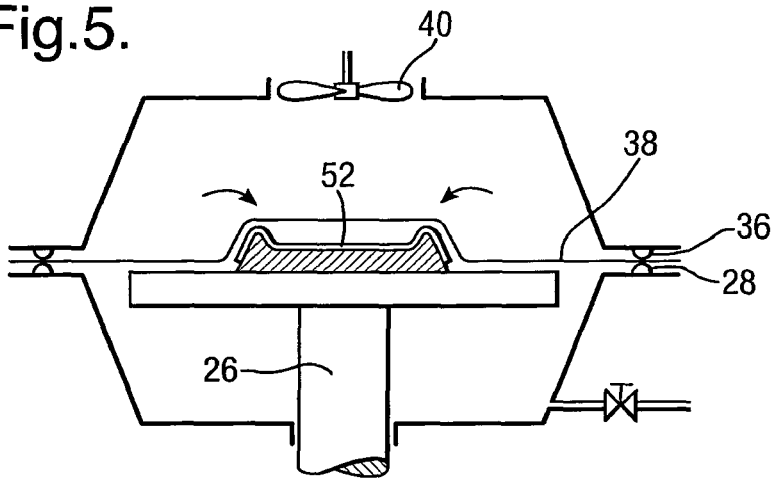
Figure 6:
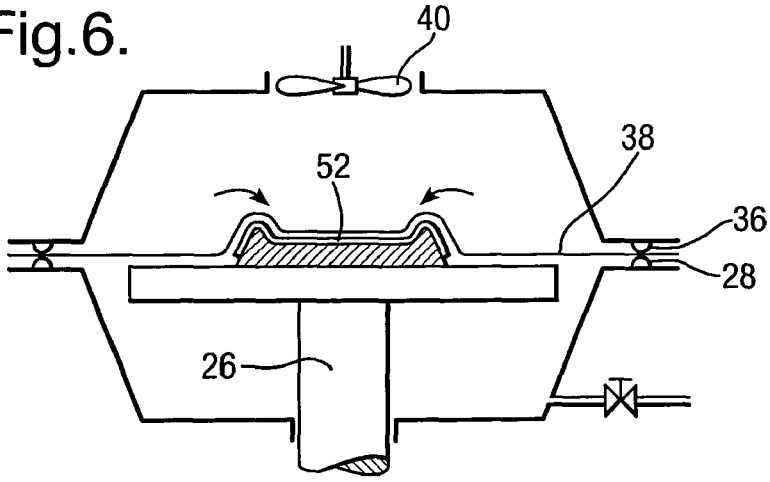

The base unit includes a recess 16 in which is located a table 18 for receiving an array of 3D is articles to be printed on or decorated. Resting on table 18 is a nest plate 20 of porous aluminium or fibre carrying a support 22 (commonly referred to as a "nest" and described in detail below with reference to FIGS. 7 to 11*b*) shaped to be complementary to the article 52 to be printed on, to act as a support therefor and prevent distortion of the article that might otherwise occur on heating. A peripheral rubber seal 24 is provided on the upper surface of the nest plate 20 to seal within the base unit. Table 18 can be raised and lowered on a shaft 26 by a lifting cylinder mechanism (not shown) from an initial lowered position (as shown in FIGS. 1, 3 and 4) to a raised position (as shown in FIGS. 5 and 6).

The periphery of the recess 16 is surrounded by linear film guides 27 (visible in FIG. 1) for accurately locating an A3 retransfer sheet in position over the recess and retaining the sheet in position, resting on a peripheral rubber seal 28.

The base unit 12 includes a vacuum system including a vacuum pump and bleed valve (not shown) for generating a vacuum in a flexible hose 30 that passes through table 18 to draw air out from immediately beneath the nest plate 20.

The base unit also includes a cooling fan 32 with associated electric motor.

The lid unit 14 includes a recess 34 the periphery of which is surrounded by a rubber seal 36 that cooperates with the seal 28 of the base unit to secure and seal a retransfer sheet 38 therebetween in the housing when the lid unit is in the closed position. Magnetic locks 39 (visible in FIG. 1) are provided for securing the lid unit in the closed position.

The lid unit 14 includes heating means comprising a fan 40 with associated motor 42 and downstream electrical heater elements 44 for directing a flow of hot air downwardly in the lid unit. Heated air passes upwardly through channels 46 to be recirculated within the housing.

The apparatus includes computer control means (not shown) and a control panel 66 including display means at the front of the base unit, visible in FIGS. 1 and 2.

In use, an image to be printed on a 3D article is printed (in reverse) onto a suitable retransfer intermediate sheet 38. In one embodiment an image is printed onto Pictaflex A3+ roll media from ICI Imagedata (Pictaflex is a Trade Mark) by an inkjet printing process on an Epson 4400 printer (Epson is a Trade Mark) using Artainium dye sublimation inks (Artainium is a Trade Mark), cut to A3 sheet size and allowed to dry.

An article 52 to be printed on is placed in the base unit 12, resting on the support 22, with the surface to be decorated uppermost. Depending on the nature of the surface of the article on which the image is to be formed, it may be appropriate to pretreat the surface by application of a surface coating or lacquer to improve the take up of transferred dyes.

The lid unit 14 is moved manually to the closed position.

The heating means is activated in an article preheating step, with the fan 40 causing hot air at a temperature of about 110° C. to be recirculated within the housing for about 30 seconds. This acts to preheat the article 52 to be decorated.

The lid unit 14 is then manually moved to the open position.

The printed A3 Pictaflex film sheet 38 is placed in position on the base unit 12 over recess 16 within the guides and resting on the seal 28, with the printed side facing the article. The lid unit is manually moved to the closed position, being retained by the magnetic lock, sealing sheet 38 in position between seals 28 and seals 36, as shown in FIGS. 3 to 6.

In a sheet preheating step, the heating means is activated, with the fan causing hot air at a temperature of about 130° C. to be recirculated within the apparatus for about 30 seconds. At this temperature the sheet 38 softens and becomes viscoelastic and has a very low yield stress.

While maintaining heating, the table 18 is raised so that article 52 passes through the softened sheet 38, as shown in FIG. 5, with the sheet initially being loosely draped around the article.

In a vacuum step, while maintaining heating the vacuum system in the base unit 12 is then operated, generating a vacuum of 15 inches Hg (about 50 kPa) below atmospheric beneath the sheet, via hose 30, which acts to draw the sheet against the article, as shown in FIG. 6, with the seals 24 and 28 acting to maintain a vacuum. The softened sheet conforms to the shape of the article 52. A gasket (not shown) made from an elastomeric material can be placed between the nest plate 20 and the support 22 to avoid any gaps between the nest plate and support, since the softened sheet might otherwise be forced into any such gaps and rupture. The temperature of the heating means is raised in a dye transfer step to generate hot air at a temperature of about 160° C., with the temperature being held at this level for about 120 seconds. At this elevated temperature dye diffuses from the sheet into the adjacent surface of the article.

The table 18 is lowered after an appropriate time, and the vacuum released. In a cooling step, cold air is blown upwardly in the base unit 12 by the cooling fan 32 for about 20 seconds to impinge on the article 52 from below. This acts to cool the article and sheet.

The lid unit 14 is then manually moved to the open position. The sheet 38 is removed and discarded and the article 52 removed.

Operation of the heating means, vacuum system and cooling fan are under the control of the computer control means. The apparatus includes a number of preset programs suitable for printing onto a variety of different materials, and is also programmable by a user to suit other requirements.

Figure 7:
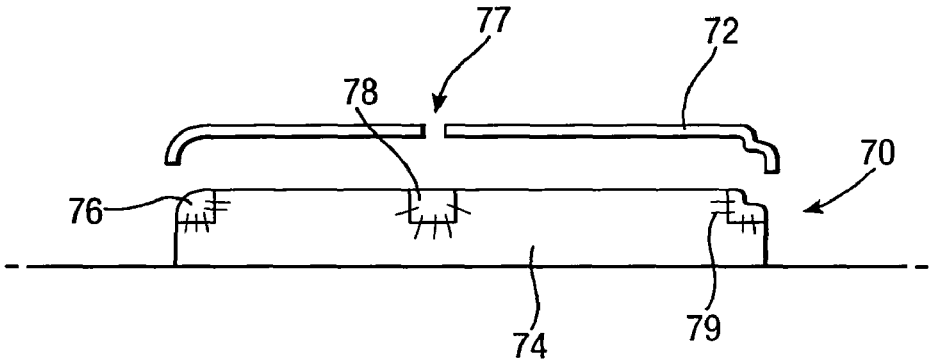
FIGS. 7, 8, 9*a*, 9*b*, 10, 11*a* and 11*b* are sectional views of six embodiments of supports.

FIG. 7 shows a simplified form of a first embodiment 70 of the support 22, together with an article 72 that would rest on the support during use of the apparatus. The support is generally rectangular in plan and is intended for use with an article 72 that has one or more openings, of which only one is shown in FIG. 7 for the purpose of simplicity, denoted by reference numeral 77.

The first embodiment 70 comprises a rigid body 74 provided with first and second pads 76 and 78, the pads being secured to the body by strips of glass fibre mat, one of which is denoted by reference numeral 79. The first pad 76 extends around the periphery of the upper surface of the support and has a shape corresponding to a footprint of the article 72.

The method of making the first embodiment 70 is as follows.

A mould is formed from modelling clay with a cavity corresponding to the shape of the support 70 and first and second clay walls are constructed inside the cavity, the first clay wall dividing the cavity into a large central portion and an outer peripheral channel, and the second clay wall dividing the large central portion of the cavity into a small central portion and an inner peripheral channel. A release agent is applied to all surfaces of the cavity and clay walls. First ends of strips of glass fibre mat are embedded into the first clay wall so that their second ends project into the outer peripheral channel.

Silastic (Silastic is a trade mark) silicone resin type S (available from Dow Corning Corporation) is mixed and poured into the small central portion to form the pad 78 and the outer peripheral channel of the cavity to form the pad 76. Just before the silicone resin starts to gel, first ends of further strips of glass fibre mat are embedded into the exposed surfaces of the silicone resin so that their second ends project from the surfaces of the silicone resin into the mould cavity. The clay walls are removed and the silicone resin is allowed to cure, then the release agent is applied to the surfaces of the cavity previously covered by the clay walls.

Epoxy resin is mixed and poured into the mould cavity to fill the cavity and form the body 74. The epoxy resin surrounds the second ends of the strips of glass fibre mat and when hardened, the strips of glass fibre mat are firmly attached to the body 74 and the pads 76 and 78 so that the pads are fastened to the body 74.

The pad 76 extends around the periphery of the body 74 such that when the article 72 is placed on the support, a peripheral edge of the article engages with, and deforms, the pad 76, which conforms to the edge. The pad 78 occupies a portion near the middle of the upper surface of the body 74, such that when the article 72 is placed on the support, an edge of the article that defines a hole 77 in the article engages with the pad 78, which conforms to the edge of the hole 77. The hole 77 is rectangular, as is the pad 78 in plan, but the pad has a larger area than the hole, so that the hole is sealed by the pad 78.

The engagement of the edges of the article 72 with the pads 76 and 78 prevents any gaps which might otherwise be present between the surface of the body 74 and the article 72, into which gaps the softened sheet 38 could be forced when the vacuum is applied.

Figure 8:
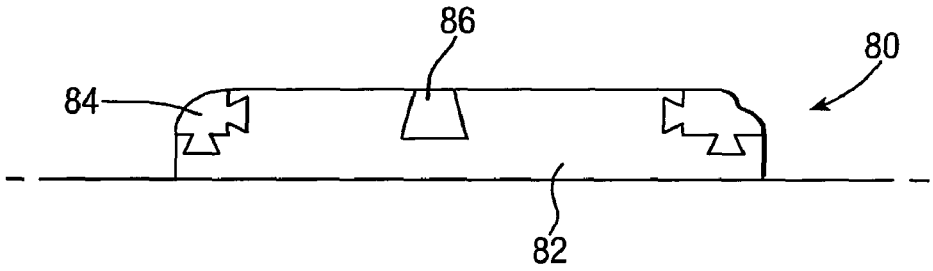

FIG. 8 shows a second embodiment 80 of the support 22, comprising a rigid body 82 provided with first and second pads 84 and 86.

The method of making the second embodiment 80 is as follows.

As for the first embodiment 70, a mould is formed and first and second clay walls are constructed inside the cavity. The first wall divides the cavity into a large central portion and an outer peripheral portion and also substantially encloses the outer peripheral portion except for holes through which the silicone resin can be poured. The wall is either shaped such that it is of greater thickness where it abuts the mould, i.e. the width of the cross-section of the outer peripheral portion of the cavity decreases with depth into the cavity, or is provided on the side adjacent to the outer peripheral portion of the cavity with re-entrant openings.

The second wall divides the large central portion of the cavity into a small central portion and an inner peripheral channel. The second wall is shaped such that it is wider where it abuts the mould, i.e. the width of the cross-section of the small central portion of the cavity decreases with depth into the cavity.

The silicone resin is mixed and poured into the small central portion to form the pad 86 and the outer peripheral channel of the cavity to form the pad 84. Once the silicone resin has cured the clay walls are removed and release agent is applied to the surfaces of the cavity previously covered by the clay walls.

Epoxy resin is mixed and poured into the mould cavity to fill the cavity to form the body 82. When the epoxy resin has hardened the pads 84 and 86 are firmly attached to the body 82, because the shapes of the first and second walls cause the pads to have portions that interlock with the body 82.

In use of the support the operation of the pads 84 and 86 is the same as those of the first embodiment.

Figure 9A:
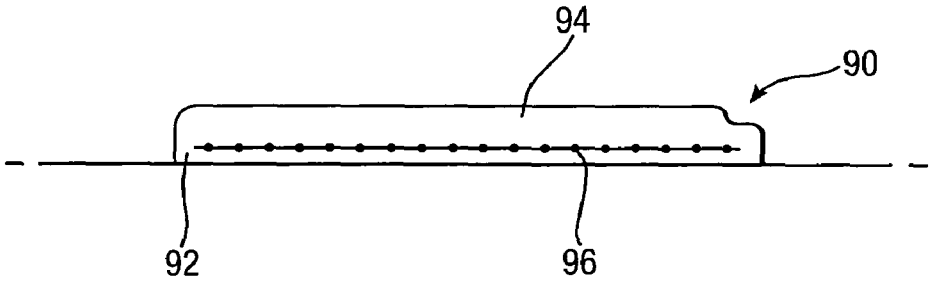

FIG. 9*a* shows a third embodiment 90 of the support 22, comprising a body portion 92 integrally formed with a surface portion 94, the body portion 92 being formed around a glass fibre mat 96 that renders the body portion substantially rigid.

The method of making the third embodiment 90 is as follows.

A mould is formed and a release agent is applied to all surfaces of the cavity. The silicone resin is mixed and poured into the mould to fill the cavity to two thirds of its depth to form the surface portion 94 and part of the body portion 92. The silicone resin is allowed to gel and the glass fibre mat 96 is laid on the partially cured silicone resin. Once the silicone resin has cured, more silicone resin is mixed and poured into the cavity to fill the cavity to form the remainder of the body portion 92.

When the article 72 is placed on the support, the peripheral edge of the article and the edge defining the hole 77 of the article engage with corresponding regions of the surface portion 94, which conform to the edges, so preventing any gaps between the edges of the article and the support.

Figure 9B:
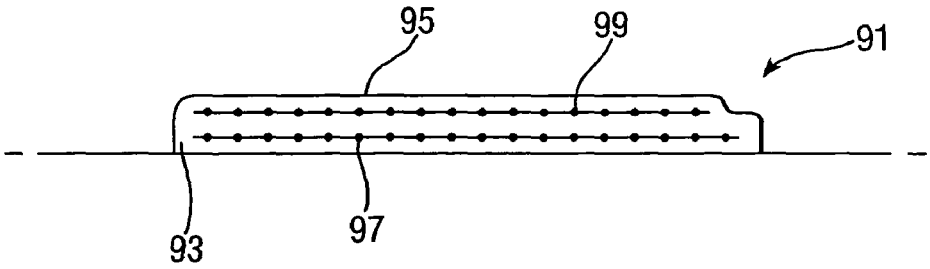

FIG. 9*b* shows a fourth embodiment 91 of the support 22, comprising a body portion 93 integrally formed with a surface portion 95, the body portion 93 being formed around a first glass fibre mat 97 and the surface portion 95 being formed around a second glass fibre mat 99. The glass fibre mats 97 and 99 are not woven mats, although they are shown as such in FIG. 9*b*, but rather mats comprising a plurality of glass fibres arranged in substantially random orientations along the mats.

The method of making the fourth embodiment 91 is as follows.

A mould is formed using an article to be decorated to define the shape of the cavity of the mould. A release agent is applied to all surfaces of the cavity. The silicone resin is mixed and poured into the mould to fill the cavity to one third of its depth to form the surface portion 95. The silicone resin is allowed to gel and the glass fibre mat 99 is laid on the partially cured silicone resin.

Once the silicone resin has cured, more silicone resin is mixed and poured into the cavity to fill the cavity to two thirds of its depth to form part of the body portion 93. This silicone resin is allowed to gel and the glass fibre mat 97 is laid on the partially cured silicone resin. Once this silicone resin has cured, more silicone resin is mixed and poured into the cavity to fill the cavity to form the remainder of the body portion 93.

When the article 72 is placed on the support, the peripheral edge of the article and the edge defining the hole 77 of the article deform the corresponding regions of the surface portion 95, which conform to the edges, so preventing any gaps between the edges of the article and the support.

The silicone resin has a high thermal expansion coefficient as compared with most articles to be decorated. In the absence of the glass fibre mats 97 and 99 this would be a problem when the support and article are heated to decorate the article, as the width and breadth of the support would increase and either force the article off the support or deform the article.

The glass fibre mats 97 and 99 ensure that the width and breadth of the support remain substantially constant as the support is heated to the temperature at which the article is decorated, the thermal expansion of the support being accommodated in an increase in the depth of the support, which does not affect the decoration process.

Comparative tests have been carried out using supports with and without the glass fibre mats. A support for a lid of a laptop computer was made without the glass fibre mats. This had a width of 351.0 mm at 20° C. and 356.7 mm at 80° C. This increase in width caused the lid of the laptop computer to be forced off the support, with consequent puncture of the film sheet and failure of the decoration process.

A similar support was made using the glass fibre mats. This had a width of 351.0 mm at 20° C. and 352.1 mm at 80° C., i.e. the change of width of the support due to thermal expansion was reduced by over 80 percent. The decoration process was completed satisfactorily using this support.

The two glass fibre mats have also been found to prevent the edges of the support from curling upwards as the support is heated.

Figure 10:
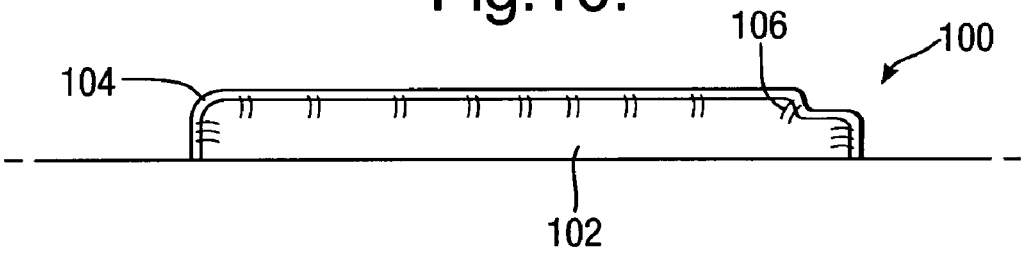

FIG. 10 shows a fifth embodiment 100 of the support 22, comprising a rigid body 102, covered by a skin 104, the skin being secured to the body by strips of glass fibre mat, one of which is denoted by reference numeral 106.

The method of making the fifth embodiment 100 is as follows.

A mould is formed and a release agent is applied to all surfaces of the cavity. The silicone resin is mixed and painted on the surface of the cavity to a thickness of about 5 mm to form the skin 104. Before the silicone resin gels, first ends of strips of fibre glass mat are embedded into the silicone resin, with the second ends of the strips projecting into the cavity. The silicone resin is allowed to cure, then epoxy resin is mixed and poured into the cavity to fill the cavity to form the body 102.

The epoxy resin surrounds the second ends of the strips of glass fibre mat and when hardened, the strips of glass fibre mat are firmly attached to the body 102 and skin 104, fastening the skin to the body.

When the article 72 is placed on the support, the peripheral edge of the article and the edge defining the hole 77 of the article engage with, and deform, corresponding regions of the skin 104, so preventing any gaps between the edges of the article and the support.

Figure 11A:
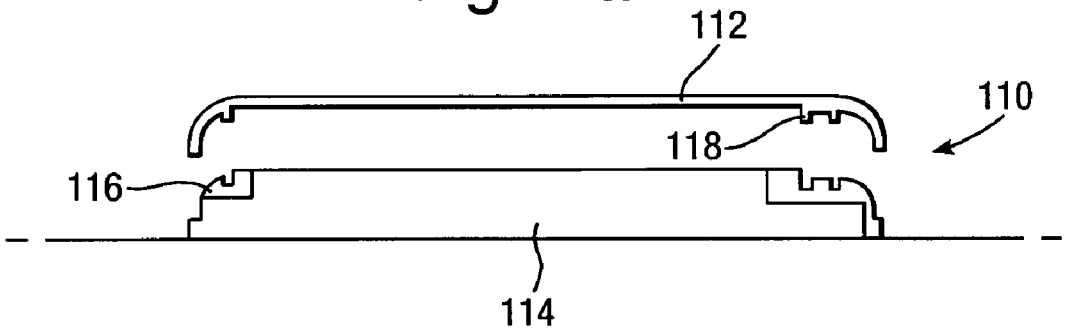
Figure 11B:
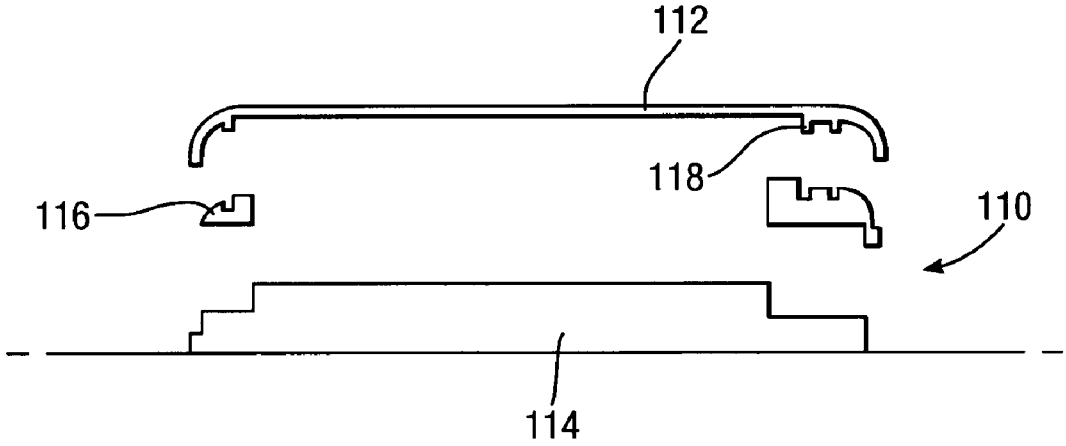

FIGS. 11*a* and 11*b* show a sixth embodiment 110 of the support 22, together with an article 112 that would rest on the support during use of the apparatus.

The sixth embodiment 110 comprises a rigid body 114 and a removable pad 116. The removable pad 116 is shown fitted to the body 114 in FIG. 11*a* and removed from the body 114 in FIG. 11*b*.

The method of making the sixth embodiment 110 is as follows.

A mould is formed and a clay wall is constructed inside the cavity. The wall divides the cavity into a central portion and a peripheral portion. Projections are formed from a bottom surface of the cavity in the peripheral portion of the cavity, the projections corresponding to projections of the article 112, one of the projections being denoted by reference numeral 118.

The silicone resin is mixed and poured into the peripheral channel of the cavity to form the pad 116. Once the silicone resin has cured the clay wall is removed and release agent is applied to the surfaces of the mould previously covered by the clay wall.

Epoxy resin is mixed and poured into the mould cavity to fill the cavity to form the body 114, and allowed to cure.

Should it be unnecessary for the pad 116 to extend completely around the periphery of the body 114, two or more separate pads may be provided instead of the pad 116. In that event, engagement of the projections 118 of the article with the holes formed in the pads by the projections of the mould helps to prevent movement of the pads relative to the body 114 during use of the support.

Comparative tests have been carried out using apparatus in accordance with the invention, including the supports shown in FIGS. 7, 8, 9*a*, 9*b*, 11*a* and 11*b*, and comparable apparatus without the supports. These have shown that more uniform prints of superior quality were obtained using apparatus in accordance with the invention. Use of the supports of the invention has allowed articles made from plastics materials to be printed using thermal transfer printing, which parts would have been deformed to an unacceptable degree at the temperature and pressure used in thermal transfer printing without the support because the elastomeric material enables the article to be supported evenly, and has avoided puncturing of the film sheet, which would otherwise have adversely affected the thermal transfer printing process.

It will be appreciated that the use of an elastomeric material to form at least a portion of the engagement surface has the further significant advantage that the article to be decorated can be used to form the cavity in the mould for making the support. Previously, it was necessary to make a slightly reduced model of the article to form the cavity in order to accommodate the thickness of the article to be decorated.

The invention claimed is:

1. A support for an article onto which an image is to be printed by thermal transfer printing from a retransfer intermediate sheet, comprising: an engagement surface generally shaped for engagement with the article; and a body formed from an elastomeric material and provided with a structure that substantially prevents deformation of the parts of the body other than the engagement surface, wherein at least a portion of the engagement surface is formed from the elastomeric material, and wherein the elastomeric material has the form of a solid pad of generally similar shape to a footprint of the article, but of larger area, so that when the article is engaged with the engagement surface, the peripheral edge of the article is located inside a peripheral edge of the pad.

2. The support according to claim 1, wherein the elastomeric material is shaped such that, at least at a temperature at which thermal transfer printing takes place, when the article is engaged with the engagement surface the elastomeric material conforms to an edge of the article.

3. The support according to claim 2, wherein the elastomeric material is shaped such that, at least at a temperature at which thermal transfer printing takes place, when the article is engaged with the engagement surface the elastomeric material conforms to a peripheral edge of the article.

4. The support according to claim 1, wherein the structure comprises at least one layer of relatively inextendible fibres, the body being formed around the at least one layer with the at least one layer disposed substantially parallel to the engagement surface.

5. The support according to claim 4, wherein the at least one layer of relatively inextendible fibres comprises at least one mat comprising a plurality of fibres arranged in substantially random orientations along the mat.

6. A method of making a support for an article onto which an image is to be printed by thermal transfer printing from a retransfer intermediate sheet, the method comprising forming a body from an elastomeric material and providing said body with a structure that substantially prevents deformation of the parts of the body other than an engagement surface, the engagement surface generally being shaped for engagement with the article, and forming at least a portion of the engagement surface from the elastomeric material.

7. The method according to claim 6, wherein forming at least a portion of the engagement surface from the elastomeric material comprises applying a hardenable elastomeric material to at least one portion of a cavity of a mould.

8. The method according to claim 7, wherein the cavity is formed using the article.

9. The method according to claim 7, wherein forming a support with an engagement surface shaped for engagement with the article comprises filling the cavity of the mould around the elastomeric material with a material that hardens to form a rigid structure.

10. The method according to claim 6, wherein forming at least a portion of the engagement surface from the elastomeric material comprises filling a cavity of a mould to a first level with a hardenable elastomeric material and forming a support with an engagement surface shaped for engagement with the article comprises forming a layer of relatively inextendible fibres over the hardenable elastomeric material in the cavity of the mould, then filling the remainder of the cavity with more of the hardenable elastomeric material to cover the layer of fibres.

11. The method according to claim 10, wherein forming a layer of relatively inextendible fibres over the hardenable elastomeric material in the cavity of the mould comprises laying a mat comprising a plurality of fibres arranged in substantially random orientations along the mat over the hardenable elastomeric material in the cavity of the mould.

12. The method according to claim 8, wherein forming a support with an engagement surface shaped for engagement with the article comprises filling the cavity of the mould around the elastomeric material with a material that hardens to form a rigid structure.

13. An apparatus for thermal transfer printing of an image from a retransfer intermediate sheet onto an article, the apparatus including heating means adapted to supply a flow of heated gas for causing dye transfer, a pump adapted to establish a pressure difference across the sheet, and at least one support for the article, the support having an engagement surface generally shaped for engagement with the article, the support having a body formed from an elastomeric material and provided with a structure that substantially prevents deformation of the parts of the body other than the engagement surface, and wherein at least a portion of the engagement surface is formed from the elastomeric material, and wherein the elastomeric material has the form of a solid pad of generally similar shape to a footprint of the article, but of larger area, so that when the article is engaged with the engagement surface, the peripheral edge of the article is located inside a peripheral edge of the pad.

14. A method of printing an image from a thermal retransfer sheet onto an article, comprising causing the sheet and article to come into contact; and heating the sheet by exposure to a flow of heated gas to cause dye transfer from the sheet to the article, wherein the article is engaged with an engagement surface of a support, the support having a body formed from an elastomeric material and provided with a structure that substantially prevents deformation of the parts of the body other than the engagement surface, the support having the engagement surface generally shaped for engagement with the article, and wherein at least a portion of the engagement surface is formed from the elastomeric material, and wherein the elastomeric material has the form of a solid pad of generally similar shape to a footprint of the article, but of larger area, so that when the article is engaged with the engagement surface, the peripheral edge of the article is located inside a peripheral edge of the pad.

* * * * *